US009847593B2

(12) United States Patent
Nunner et al.

(10) Patent No.: US 9,847,593 B2
(45) Date of Patent: Dec. 19, 2017

(54) ELECTRICAL CONNECTOR ASSEMBLY AND CONNECTION ARRANGEMENT

(71) Applicant: YAZAKI EUROPE LTD., Hemel Hempstead, Hertfordshire (GB)

(72) Inventors: Hans Nunner, Regensburg (DE); Goran Petrovic-Poljak, Zagreb (HR); Zelimir Loncar, Sesvete (HR); Ozren Milazzi, Zagreb (HR)

(73) Assignee: YAZAKI EUROPE LTD., Herfordshire (GB)

( * ) Notice: Subject to any disclaimer, the term of this patent is extended or adjusted under 35 U.S.C. 154(b) by 0 days.

(21) Appl. No.: 14/965,453

(22) Filed: Dec. 10, 2015

(65) Prior Publication Data

US 2016/0172781 A1 Jun. 16, 2016

(30) Foreign Application Priority Data

Dec. 12, 2014 (EP) ..... 14197778

(51) Int. Cl.
*H01R 13/42* (2006.01)
*H01R 4/38* (2006.01)
(Continued)

(52) U.S. Cl.
CPC ..... *H01R 13/42* (2013.01); *H01R 4/38* (2013.01); *H01R 4/34* (2013.01); *H01R 9/24* (2013.01); *H01R 11/12* (2013.01)

(58) Field of Classification Search
CPC ..... H01R 13/42
(Continued)

(56) References Cited

U.S. PATENT DOCUMENTS 3,960,427 A * 6/1976 Piaget ..... H01R 4/70 174/138 F
4,478,478 A * 10/1984 Durand ..... H01R 4/301 439/625
(Continued)

FOREIGN PATENT DOCUMENTS

DE 10 2012 018 086 A1 3/2014
FR 2 623 933 A1 6/1989
(Continued)

OTHER PUBLICATIONS

Communication dated Oct. 25, 2016 from the Japanese Patent Office in counterpart Application No. 2015-240250.

*Primary Examiner* — Tulsidas C Patel
*Assistant Examiner* — Marcus Harcum
(74) *Attorney, Agent, or Firm* — Sughrue Mion, PLLC

(57) ABSTRACT

An electrical connector assembly 1 comprising:
a terminal holder 18, and
a fastening assembly 20, accommodated within the terminal holder 18, for clamping a plurality of terminals 3, 4 in the direction of a longitudinal axis L for an electrical connection between said terminals 3, 4, said fastening assembly 20 including a first fastening member 23 made of a metal material and a second fastening member 29 which first and second fastening members 23, 29 are connected to each other for clamping said terminals 3, 4 and which define a terminal receiving area 37, wherein the electrical connector further comprises an insulation arrangement 30 which is arranged between said first fastening member 23 and the terminal receiving area 37.

12 Claims, 3 Drawing Sheets

Figure 1:
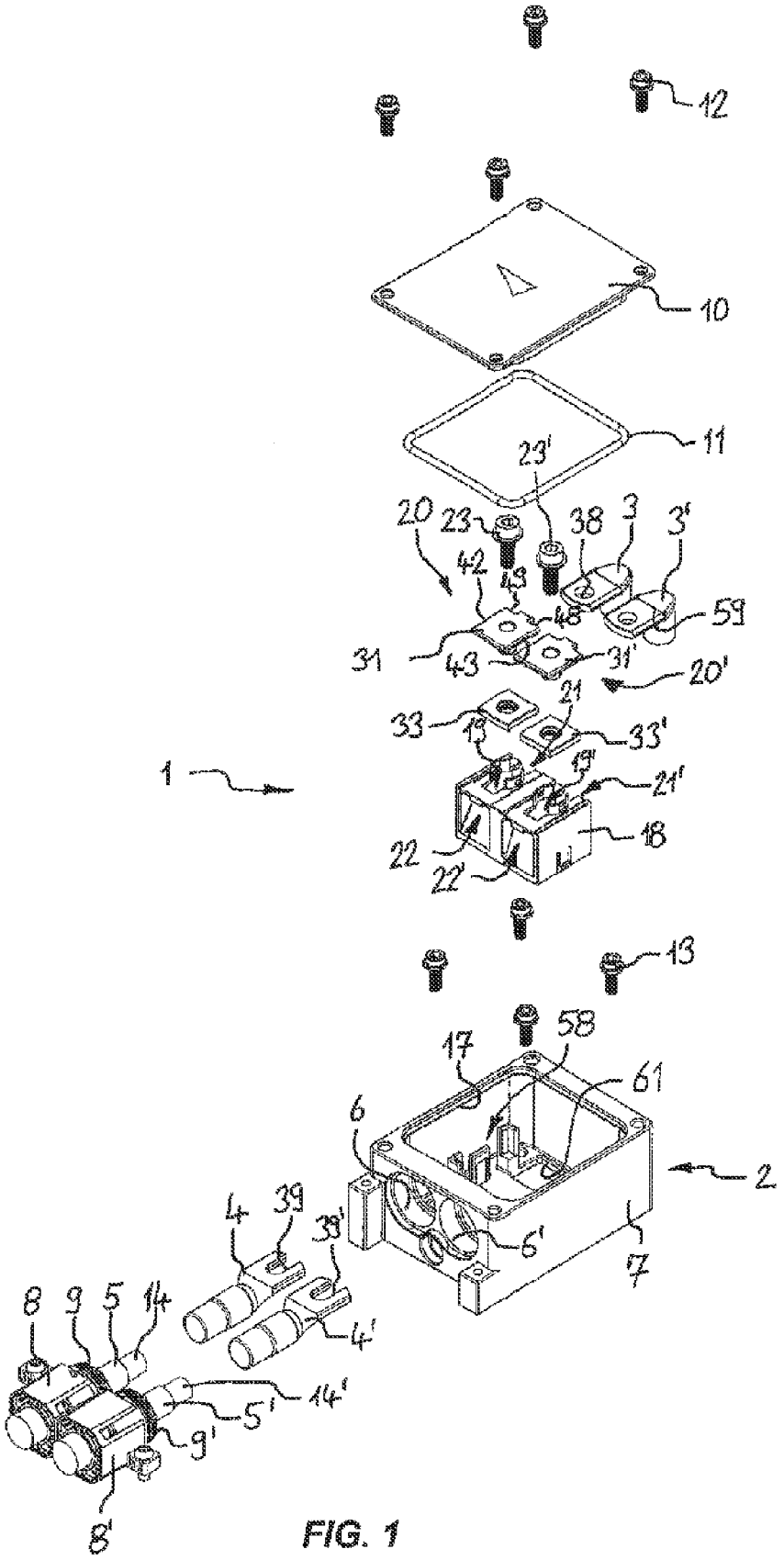

(51) Int. Cl.
*H01R 4/34* (2006.01)
*H01R 9/24* (2006.01)
*H01R 11/12* (2006.01)

(58) Field of Classification Search
USPC ..... 439/810–815
See application file for complete search history.

(56) References Cited

U.S. PATENT DOCUMENTS 5,244,423 A * 9/1993 Erickson ..... H02G 5/02 439/798
6,443,783 B1 * 9/2002 Beadle ..... H01R 9/2425 439/718
8,608,518 B2 * 12/2013 Wu ..... H01R 4/302 439/812
8,672,700 B2 3/2014 Matsumoto et al.
2005/0202732 A1 * 9/2005 Rizzo ..... H01R 4/36 439/810
2011/0065335 A1 * 3/2011 Hain ..... H01R 4/301 439/810
2011/0070761 A1 * 3/2011 Takehara ..... H01R 4/305 439/271
2013/0244458 A1 9/2013 Falk et al.
2014/0349528 A1 * 11/2014 Wu ..... H01R 4/34 439/810

FOREIGN PATENT DOCUMENTS

JP 50-144298 U 11/1975
JP 2004-56924 A 2/2004
JP 2011-113944 A 6/2011

* cited by examiner

ELECTRICAL CONNECTOR ASSEMBLY AND CONNECTION ARRANGEMENT

The invention refers to an electrical connector assembly comprising a terminal holder, and a clamping assembly for clamping a plurality of terminals in the direction of a longitudinal axis for an electrical connection between said terminals, said clamping assembly including a first clamping element made of a metal material and a second clamping element which first and second clamping elements are connected to each other for clamping said terminals and which define a terminal receiving area. In addition, the invention refers to a connection arrangement comprising such a connector assembly and a first terminal and a second terminal received in the terminal receiving area of the clamping assembly and being clamped by said clamping assembly for an electrical connection between said first and second terminals.

Electrical connector assemblies of that type are described in U.S. Pat. No. 8,672,700 B2 and US 2011/0070761 A1.

A motor vehicle includes a variety of electronic devices. A hybrid car or an electric car includes, for example, an electric motor and an inverter to invert a direct current power of a battery to an alternating current power. It is known that a connector assembly is utilized for connection between the motor and the inverter. The connector connected to the motor with an electrical wire is attached to a connector receptacle of the inverter is, for instance, described in JP H11-126661 A. The connector assembly of JP H11-126661 A includes a connector (an assembly of connection terminals) and a connector receptacle. The connector has a terminal and a connector housing receiving the terminal. The terminal has a hole to accept a bolt.

The connector receptacle has a box shaped case with an insertion hole to accept entry of the connector, and a terminal portion to be superposed with the terminal when the connector is positioned in the insertion hole. The terminal portion has a second hole to be communicated with the hole of the terminal. The insertion hole is disposed on a side surface of the case. The case has a fastening hole at an upper surface. The fastening hole communicates with the insertion hole and accepts a bolt (fastening member) to fasten the terminal and the terminal portion together.

The connector assembly is assembled with the connector and the connector receptacle as follows. The connector is approached to the side surface of the case and inserted into the insertion hole. The terminal is superposed on the terminal portion to communicate the hole and the second hole one another. The bolt is then inserted from the upper surface of the case through the fastening hole into the communicated hole and the second hole so that the terminal and the terminal portion are fastened with the bolt.

In the conventional connector assembly, the connector is inserted into the insertion hole of the connector receptacle from the side surface of the case, and the fastening member is inserted from the upper surface of the case through the fastening hole to fasten the terminal and the terminal portion. It is thus necessary for the case to have an insertion space at the side surface to accept entry of the connector and a fastening area at the upper surface of the case to accept entry of the fastening member.

The necessity of the attachment spaces (insertion space and fastening area) limits an effective use of a limited space in the car.

U.S. Pat. No. 8,672,700 B2, therefore, proposes a solution permitting attachment of a connector to a connector receptacle in a reduced space. Accordingly the connector assembly described in U.S. Pat. No. 8,672,700 B2 comprises: a connector including a terminal and a connector housing for receiving the terminal; a connector receptacle including a case having an insertion hole for accepting entry of the connector, and a terminal portion received in the insertion hole and to be connected with the terminal; and a fastening member for fastening the connector and the connector receptacle together, wherein the terminal has an electrical connection portion to be connected with an electrical wire, and an electrical contact portion upstanding from the electrical connection portion and having a hole, the connector housing includes a housing main body for receiving the electrical connection portion, and a column portion connected to the housing main body and having the central axis along an insertion direction of the connector, and for receiving the electrical contact portion with the hole disposed along the insertion direction, the terminal portion has a connection portion with a second hole to be communicated with the hole when the electrical contact portion is superposed on the connection portion, the case includes a case main body having the insertion hole, and a housing portion attached to the case main body and supporting the connection portion so that the second hole is aligned with the insertion direction, and wherein when the connector is positioned inside of the insertion hole of the connector receptacle, and the electrical contact portion is superposed on the connection portion, the fastening member is insertable from the opening of the column portion into the communicated hole and the second hole, and is capable of fastening the electrical contact portion and the connection portion together.

The fastening member is a screw as a first fastening member which is screwed into an inside thread of a second fastening member. Between the two fastening members the connection portion as a first terminal and an electrical contact portion as second terminal are clamped. The screw is in direct electrical contact to the terminals so that there is the need to use special electrical insulated tools for fastening the fastening assembly and there is the danger for the assembling person to touch current leading members of the connector assembly.

The object of the present invention is to provide a connector assembly and a connection arrangement better protecting persons assembling the connector assembly from high voltage power.

The object is solved by the subject matter according to the independent claims. Preferred embodiments of the invention are described in the dependent claims.

The advantage of such an electrical connector assembly and such a connection arrangement is that the fastening assembly is completely electrically isolated from the electrical connection, i.e. from all parts being energized. The insulation arrangement ensures that the terminals which are to be clamped are not in electrical contact to the fastening assembly so that if the terminals are energized the fastening assembly is not energized and there is no electrical hazard if a person assembling the electrical connector assembly touches the fastening assembly even when using usual metallic tool.

Usually, in electrical vehicle or hybrid vehicle, bolt tightened eyelet connections are used. Therefore, the first fastening member is a screw (bolt) having a threaded shaft and a screw-head. The second fastening member has an inside thread receiving said threaded shaft of said screw. The terminals, in form of eyelet terminals or fork-like terminals, can be mounted onto the threaded shaft of the screw and can be tightened by the screw and the second fastening member, which preferably is a screw-nut.

Preferably, the insulation arrangement comprises an insulation sleeve made of an electrically insulating material and receiving the threaded shaft of the screw. The electrical terminals in the form of eyelet terminals or fork-like terminals are arranged around the insulation sleeve so that they do not contact the screw.

In order to further ensuring that the terminals cannot touch the screw, the insulation sleeve may be provided at one end with a flange abutting the screw-head of the screw.

The insulation arrangement may further comprise an insulation washer made of an electrically insulating material and abutting the second fastening member. The threaded shaft of the screw is led through a hole of the insulation washer. Hence, the insulation washer abuts the second fastening member so that, even if the second fastening member is made of a metal material it is ensured that neither the first fastening member nor the second fastening member can contact one of the terminals. The terminals are clamped between the screw-head and the second fastening member wherein between the screw-head and one of the terminals the flange portion of the insulation sleeve is arranged and between the second fastening member and one of the terminals the insulation washer is arranged. In addition, between the threaded shaft and all of the terminals the insulation sleeve is arranged so that the complete fastening assembly is electrically insulated from the terminals.

The hole of the insulation washer may have a portion of an increased diameter receiving a part of the insulation sleeve and supporting the insulation sleeve in a radial direction. It makes it easier to pre-assemble the insulation arrangement avoiding an unintentional movement of the insulation sleeve relative to the insulation washer unless the threaded shaft is led through the sleeve.

In order to further enable a pre-assembling of the electrical connector assembly the terminal holder may have a receptacle for receiving and holding the fastening assembly. Preferably, the terminal holder is made of an electrically insulating material such as a resin material.

The receptacle, preferably, has a first opening for inserting the fastening assembly and/or a first terminal of the plurality of terminals in a radial direction in relation to the longitudinal axis.

The receptacle may further have a second opening for inserting a second terminal of the plurality of terminals in a radial direction relative to the longitudinal axis.

In order to facilitate the pre-assembling of the insulation arrangement within the terminal holder the receptacle may have two oppositely arranged guiding grooves for receiving the flange of the insulation sleeve in a direction transversal to the longitudinal axis. The grooves are arranged parallel to each other wherein the flange may have a rectangular outer shape so that edges of the flange are parallel to the guiding grooves and can be guided therein.

The receptacle, further, may have a first recess for receiving the second fastening member and supporting the second fastening member against rotation about the longitudinal axis. Preferably, the second fastening member is a screw-nut having a hexagonal outer shape. The first recess, preferably, has a complementary hexagonal shape receiving the screw-nut and supporting the screw-nut against rotation. However, the second fastening member and the first recess may have any outer shape deviating from a circle line as long as the rotation of the second fastening member within a first recess about the longitudinal axis is avoided.

The receptacle may also have a second recess for receiving the insulation washer and supporting the insulation washer against radially removing the insulation washer out of the receptacle. The second recess and the insulation washer may also have an outer shape which deviates from a circle line such that the insulation washer is further supported within the second recess against a rotation about the longitudinal axis.

The object is also solved by a connection arrangement comprising an electrical connector assembly as described above and comprising a first terminal and a second terminal received in the terminal receiving area of the fastening assembly and being clamped by said fastening assembly for an electrical connection between said first and second terminals. The connection arrangement may comprise more than just two terminals.

The first terminal, preferably, has an eyelet portion with a hole wherein the fastening assembly is led through said hole. The second terminal may have a fork-like portion with a slot for radially mounting the second terminal onto the fastening assembly.

Hence, the first terminal may be mounted to the fastening assembly by axially moving the fastening assembly through the hole of the eyelet portion of the first terminal. The second terminal can be mounted to the fastening assembly by radially moving the second terminal onto the fastening assembly. Preferably, in such a configuration, the fastening assembly comprises a first fastening member in form of a screw and a second fastening member in form of a screw-nut.

Figure 2:
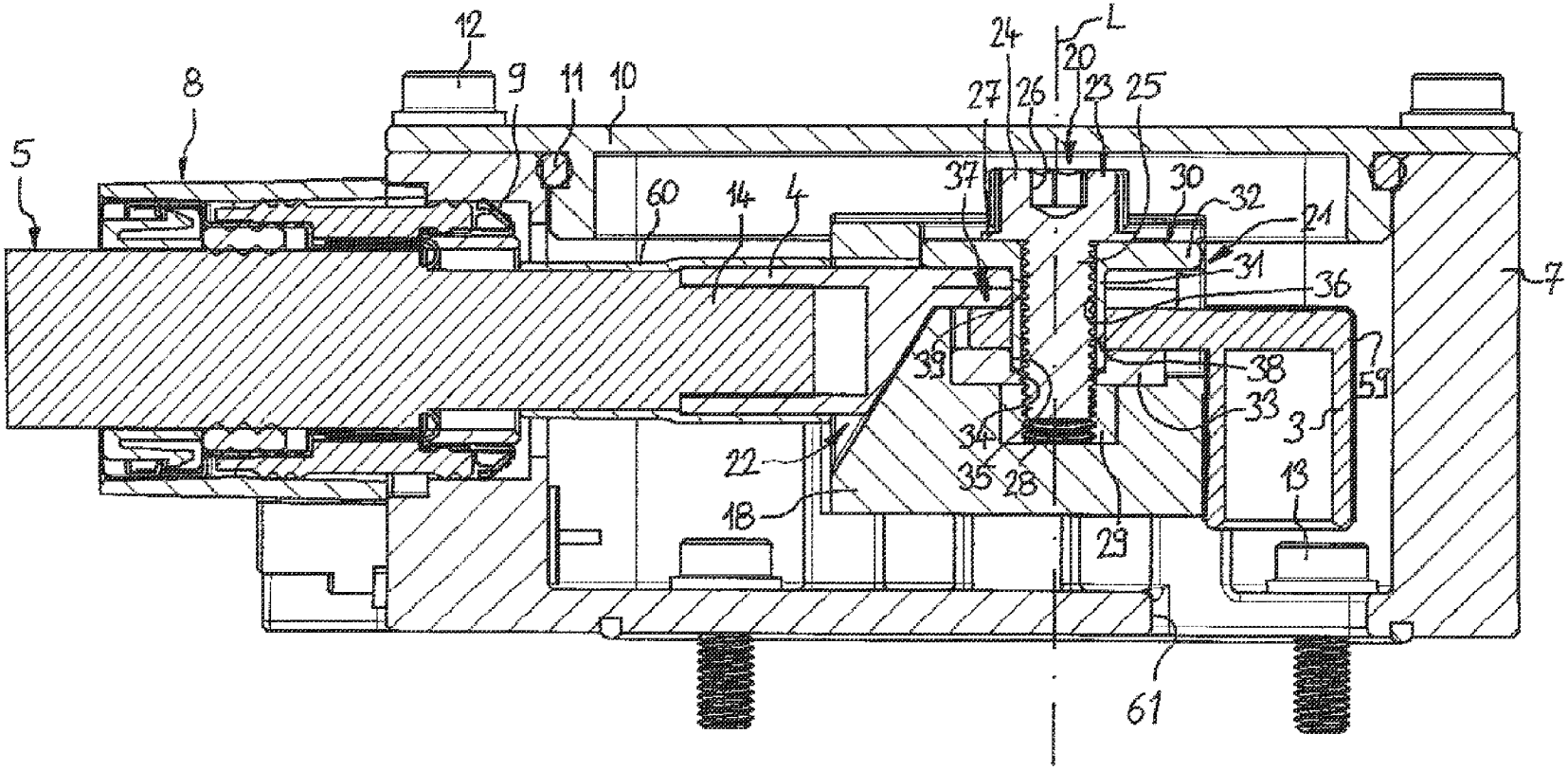
Figure 3:
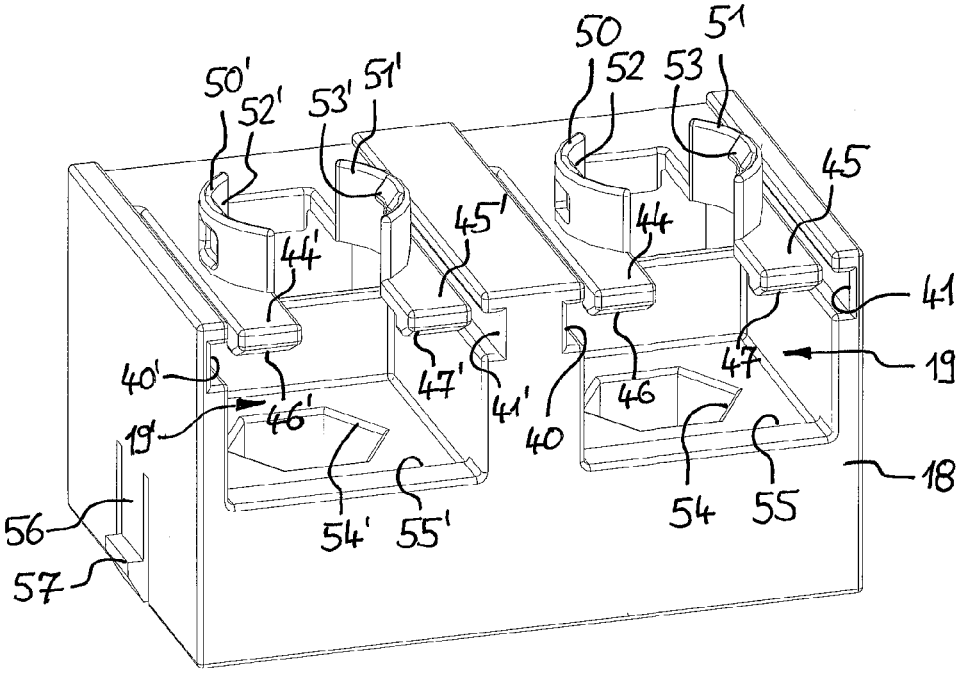
Figure 4:
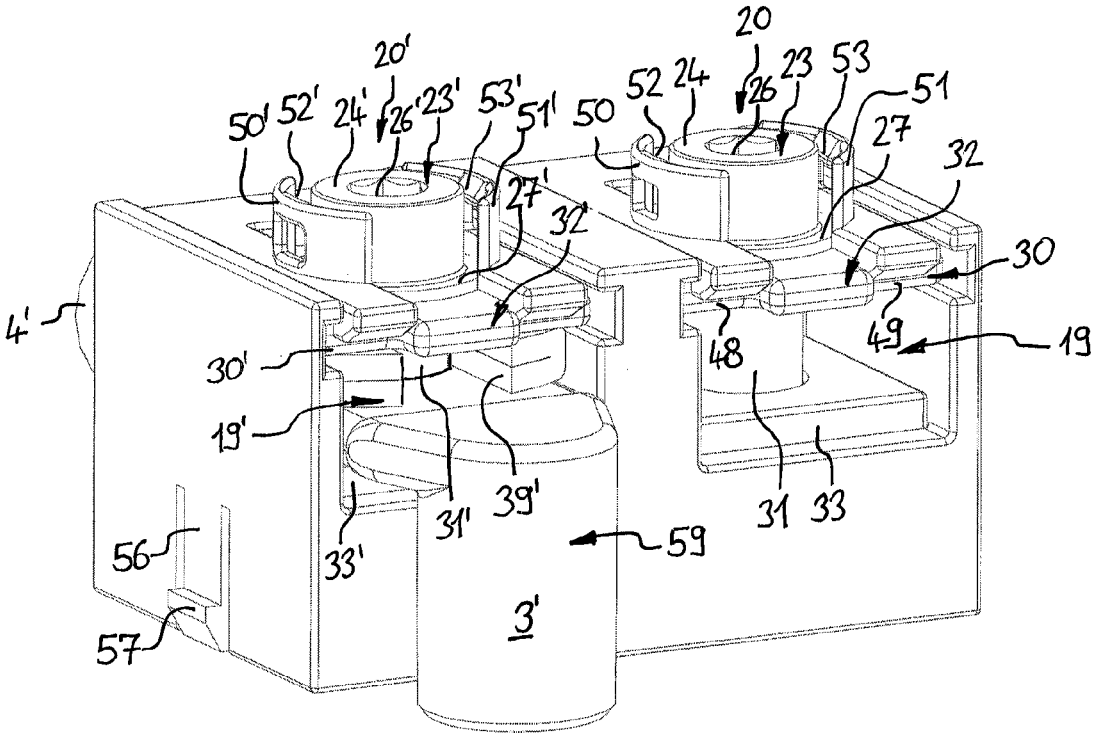

A preferred embodiment is described with reference to the following drawings, wherein FIG. 1 is a perspective exploded view of a connection arrangement with an electrical connector assembly within a case;

FIG. 2 is a longitudinal section of the arrangement according to FIG. 1, FIG. 3 is a perspective view of the terminal holder of the electrical connector assembly according to FIG. 1, and FIG. 4 is a perspective view of the terminal holder according to FIG. 3 with inserted fastening assemblies and terminals.

FIGS. 1 to 4 do depict the invention in different views and are described together.

The Figures show a connector assembly 1 which is encapsuled by a box shaped case 2 and which serves to electrically connect first terminals 3, 3' with second terminals 4, 4'. The first terminals 3, 3' may be connected to a cable leading to a battery. The second terminals 4, 4' are connected to shielded wires 5, 5' in order to distribute the electrical energy of the battery. The connector assembly 1 is a two-pole design with two pole, each of which has one first terminals 3 and one second terminal 4. Generally, the connector assembly 1 can also be of a one-pole of multiple pole design. In the following, if only one of the first terminals 3, 3' or only one of the second terminals 4, 4' is mentioned, it is described representing all other poles.

The cables (not shown) which are to be connected to the first terminals 3, 3' are guided through an opening 61 within a housing 7 of the case 2. The first terminals 3, 3' are arranged within the case 2. Each of the shielded wires 5, 5' is guided through insertion holes 6, 6' in the housing 7 so that the second terminals 4, 4' are completely arranged within the case 2. The second terminals 4, 4' are electrically connected to conductors of the shielded wires 5, 5'. The shielded wires 5, 5' are coupled to shield connectors 8, 8' which are mounted to the case 2. The shield connectors 8, 8' comprise shield terminals 9, 9' which are held in contact and, therefore, having an electrical connection to the case 2 wherein the case 2 is made of a metal material. The shield terminals 9, 9' constitute a ground connection to the case 2. The shield terminals 9, 9' are electrically connected to shield conductors 15, 15' of the shielded wires 5, 5' wherein the shield conductors 15, 15' are braided conductors surrounding the main conductor 14, 14' and a cable insulation 16, 16'.

In order to reach the connector assembly 1 to establish a connection between the first terminal 3, 3' and the second terminals 4, 4' the case 2 has an opening 17 which is closed by a cover 10. Between the cover 10 and the housing 7 a seal 11 is arranged. The cover 10 is fixed to the housing 7 by fastening bolts 12.

The housing 7 of the case 2 is fastened to an electrical device by fastening bolts 13.

The connector assembly 1 comprises a terminal holder 18 made of an electrically insulated material. The terminal holder 18 has for each hole a receptacle 19, 19' which accommodates a fastening assembly 20, 20'. As can best be seen from FIG. 2 the receptacle 19 has a first opening 21 for inserting the fastening assembly 20 and the first terminal 3 into the receptacle 19. Further, the receptacle 19 has a second opening 22 for inserting the second terminal 4.

The fastening assembly 20, which is identical to the other fastening assembly 20' as shown in FIG. 1 and which is described in the following representing the other fastening assembly 20', comprises a first fastening member 23 in form of a screw with a screw-head 24 and a threaded shaft 25. The screw-head 24 has a hexagonal recess 26 for a tool. In the area of transition between the screw-head 24 and the threaded shaft 25 the screw-head 24 has a circumferential collar 27.

The fastening assembly 20 further comprises a second fastening member 29 in form of a screw-nut. The screw-nut has an inside thread 28 in which the threaded shaft 25 is threaded. The second fastening member 29, alternatively, can be formed by the terminal holder 18 or a part of the terminal holder 18 so that the screw 23 may be threaded into an inside thread of the terminal holder 18. In the present embodiment the second fastening member 29 is a separate element.

The first terminal 3 and the second terminal 4 are clamped between the screw-head 23 and the screw-nut 29 in order to establish an electrical contact between the first terminal 3 and the second terminal 4. The area between the screw-head 24 and the screw-nut 29 around the threaded shaft 25 can be considered as a terminal receiving area 37 in which connection ends of the terminals 3, 4 are arranged for clamping.

Both, the screw 23 and the screw-nut 29 are made of a metal material so that the fastening assembly 20 is able to apply a sufficient force to the terminals 3, 4 in order to establish a reliable connection between the terminals 3, 4. In order to avoid an electrical contact between the fastening members 23, 29 and one of the terminals 3, 4 the fastening assembly 20 further comprises an insulation arrangement 30 comprising an insulation sleeve 31. The insulation sleeve 31 has a central bore 36 for accommodating the threaded shaft 25 of the screw 23. At an end of the insulation sleeve 31 which is arranged towards the screw-head 24 the insulation sleeve 31 has a flange portion 32 which extends radially from the insulation sleeve 31 and which is supported in axial direction related to the longitudinal direction L against the screw-head 24. The insulation arrangement 30 further comprises an insulation washer 33 which is arranged at the other end of the insulation sleeve opposite to the flange portion 32 and which is in supporting contact to the screw-nut 29. The insulation washer 33 has a hole 34. The threaded shaft 25 of the screw 23 is guided through the hole 34 of the insulation washer 33 and is screwed into the inside thread 28 of the screw-nut 29 on a side of the insulation washer 33 which is opposite to the screw-head 24.

In order to facilitate an easy pre-assembling of the insulation arrangement 30 the hole 34 of the insulation washer 33 has a portion of increased diameter 25 which is arranged towards the insulation sleeve 31 and which accommodates a part of the insulation sleeve 31 supporting the insulation washer 33 in a radial direction against the insulation sleeve 31.

The insulation arrangement 30 is made of an electrically insulating material, such as Polytetrafluoroethylene (PTFE). Hence, the two fastening members 23, 29 are completely insulated by the insulation arrangement 30 towards the terminal receiving area 37.

The first terminal 3 is configured in the form of a so called eyelet connector having a hole 38. The threaded shaft 25 and the insulation sleeve 31 are accommodated within the hole 38 of the first terminal 3 so that the first terminal 3 cannot come into contact with the screw 23. In an axial direction towards the nut 29 the first terminal 3 is supported against the insulation washer 33 so that the first terminal 3 cannot come into contact with the screw-nut 29, either.

The second terminal 4 can either be also in the form of an eyelet connector comparable to the first terminal or, as shown in FIG. 1, the second terminal 4 can be in the form of a fork having a slot 39 so that the second terminal 4 can be slipped onto the insulation sleeve 31 in a radial direction. As shown in FIG. 2 also the second terminal 4 is only in contact to the insulation sleeve 31 and is not in contact to the screw 23. In an axial direction the second terminal 4 is supported against the flange portion 32 of the insulation sleeve 31 so that also a contact to the screw-head 24 is avoided.

Each receptacle 19 has two oppositely arranged grooves 40, 41 which are orientated parallel to each other. The flange portion 32 of the insulation sleeve 31 has a rectangular shape with two oppositely arranged parallel edges 42, 43 which are guided in the grooves 40, 41. The grooves 40, 41 start from the first opening 21 so that the insulation sleeve 31 can be inserted into the receptacle 19 from the first opening 21. The flange portion 32 is supported in an axial direction against the grooves 40, 41.

In order to avoid that the insulation sleeve 31 can be pulled out of the grooves 40, 41 unintentionally the terminal holder 18 is provided with two elastic spring arms 44, 45 for each of the receptacles 19, 19'. The two spring arms 44, 45 are orientated parallel to the grooves 40, 41 and can be elastically deformed parallel to the longitudinal axis L. Each spring arm 44, 45 has a locking catch 46, 47 projecting from the spring arm 44, 45 towards the flange portion 32 and engaging front edges 48, 49 of the flange portion 32 so that the flange portion 32 is supported in a radial direction of the longitudinal axis L.

Each spring 44, 45 arm further comprises a wall portion 50, 51 projecting from the spring arms 44, 45 in a longitudinal direction on a side of the spring arms 44 which is opposite to the receptacle 19. Each of the wall portions 50, 51 has a locking catch 52, 53, wherein the locking catches 52, 53 are arranged towards each other. The screw-head 24 is arranged between the wall portions 50, 51 wherein the circumferential collar 27 of the screw-head 24 is held in its position by the locking catches 52, 53 as long as the screw 23 is not threaded into the nut 29.

The nut 29 has a hexagonal outer circumference and is accommodated within a first recess 54 which has a complementary shape, i.e. a hexagonal profile so that the nut 29 is secured against the rotation about the longitudinal axis L within the first recess 54.

The terminal holder 18 further comprises a second recess 55 for accommodating the insulation washer 33. The insulation washer 33 has a square outer profile and the second recess 55 has a complementary shape so that the insulation washer 33 is supported against rotation about the longitudinal axis L and cannot be pulled out of the receptacle 19 unintentionally.

The terminal holder 18 is held in a support 58 of the housing 7 of the case 2. The terminal holder 18 has two spring arms 56, one of which is shown in the drawings and which are arranged in opposite sides of the terminal holder 18. The spring arms 56 have a locking projection 57 which is in engagement with a complementary undercut of the support 58.

In order to further ensure that a person assembling the connector assembly cannot touch any energized parts the portion of the first terminal 3 which projects out of the terminal holder 18 is covered by an insulating coating 59 as can be seen in FIGS. 1 and 2 (indicated as thick black line in the cross-sectional view of FIG. 2). The eyelet part of the first terminal 3 is uncoated. The second terminal 4 is covered by an insulating tube 60 so that from above through the opening 17 of the housing 7 an operator or a person assembling the connector assembly cannot touch one of the energized parts and cannot contact an ordinary metallic tool with one of the energized parts.

REFERENCE NUMERALS

1 connector assembly
2 case
3, 3' first terminal
4, 4' second terminal
5, 5' shielded wire
6, 6' insertion hole
7 housing
8, 8' shield connector
9, 9' shield terminal
10 cover
11 seal
12 fastening bolt
13 fastening bolt
14, 14' main conductor
15, 15' shield conductor
16, 16' cable insulation
17 opening
18 terminal holder
19, 19' receptacle
20, 20' fastening assembly
21, 21' first opening
22, 22' second opening
23, 23' first fastening member (screw)
24, 24' screw-head
25 threaded shaft
26, 26' hexagonal recess
27, 27' collar
28 inside thread
29 second fastening member (screw-nut)
30, 30' insulation arrangement
31, 31' insulation sleeve
32, 32' flange portion
33, 33' insulation washer
34 hole
35 portion of increased diameter
36 bore
37 terminal receiving area
38 hole
39, 39' slot
40, 40' groove
41, 41' groove
42 edge
43 edge
44, 44' spring arm
45, 45' spring arm
46, 46' locking catch
47, 47' locking catch
48 front edge
49 front edge
50, 50' wall portion
51, 51' wall portion
52, 52' locking catch
53, 53' locking catch
54, 54' first recess
55, 55' second recess
56 spring arm
57 locking projection
58 support
59 coating
60 tube
L longitudinal axis

The invention claimed is:

1. An electrical connector assembly comprising:

a terminal holder, a fastening assembly, accommodated within the terminal holder, for clamping a plurality of terminals in the direction of a longitudinal axis for an electrical connection between said terminals, said fastening assembly including a first fastening member made of a metal material and a second fastening member which first and second fastening members are connected to each other for clamping said terminals and which define a terminal receiving area, and an insulation arrangement which is arranged between said first fastening member and the terminal receiving area, wherein the first fastening member is a screw having a threaded shaft and a screw-head, wherein the second fastening member has an inside thread receiving said threaded shaft of the first fastening member, wherein the insulation arrangement comprises an insulation sleeve made of an electrically insulating material and receiving the threaded shaft of the screw, wherein the insulation sleeve has at one end a flange portion abutting the screw-head of the screw, wherein the insulation arrangement comprises an insulation washer made of an electrically insulating material and abutting the second fastening member, wherein the threaded shaft of the screw is led through a hole of the insulation washer, and wherein the hole of the insulation washer has a portion of an increased diameter receiving the insulation sleeve and supporting the insulation sleeve in a radial direction.

2. The electrical connector assembly according to claim 1, wherein the terminal holder has a receptacle for receiving and holding the fastening assembly.

3. The electrical connector assembly according to claim 2, wherein the receptacle has a first opening for inserting the fastening assembly and/or a first terminal of the plurality of terminals in a radial direction.

4. The electrical connector assembly according to claim 2, wherein the receptacle has a second opening for inserting a second terminal of the plurality of terminals in a radial direction.

5. The electrical connector assembly according to claim 2, wherein the receptacle has two oppositely arranged guiding grooves for receiving the flange portion of the insulation sleeve in a direction transversal to the longitudinal axis.

6. The electrical connector assembly according to claim 2, wherein the receptacle has a first recess for receiving the second fastening member and supporting the second fastening member against rotation about the longitudinal axis.

7. The electrical connector assembly according to claim 2, wherein the receptacle has a second recess for receiving the insulation washer and supporting the insulation washer against radially removing the insulation washer out of the receptacle.

8. A connection arrangement comprising an electrical connector assembly according to any claim 1, and a first terminal and a second terminal received in the terminal receiving area of the fastening assembly and being clamped by said fastening assembly for an electrical connection between said first and second terminals.

9. The connection arrangement according to claim 8, wherein the first terminal has an eyelet portion with a hole wherein the fastening assembly is led through said hole.

10. The connection arrangement according to claim 8, wherein the second terminal has a fork-like portion with a slot for radially mounting the second terminal onto the fastening assembly.

11. The connection arrangement according to claim 1, wherein the insulation sleeve has only one flange portion.

12. An electrical connector assembly comprising:

a terminal holder, a fastening assembly, accommodated within the terminal holder, for clamping a plurality of terminals in the direction of a longitudinal axis for an electrical connection between said terminals, said fastening assembly including a first fastening member made of a metal material and a second fastening member which first and second fastening members are connected to each other for clamping said terminals and which define a terminal receiving area, and an insulation arrangement which is arranged between said first fastening member and the terminal receiving area, wherein the first fastening member is a screw having a threaded shaft and a screw-head and wherein the second fastening member has an inside thread receiving said threaded shaft of the first fastening member, wherein the terminal holder has a receptacle for receiving and holding the fastening assembly, and wherein the receptacle has two oppositely arranged guiding grooves for receiving a flange portion of an insulation sleeve in a direction transversal to the longitudinal axis.

* * * * *